US006301746B1

(12) United States Patent
Myers et al.

(10) Patent No.: US 6,301,746 B1
(45) **Date of Patent: *Oct. 16, 2001**

(54) TELESCOPING HANDLE ASSEMBLY FOR LUGGAGE AND OTHER LUGGABLE ITEMS

(75) Inventors: Jay Evan Myers, Newport Beach; Francis Dudley; David Laurence Stocks, both of Long Beach, all of CA (US)

(73) Assignee: Andiamo, Inc., Santa Ana, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,836

(22) Filed: Jan. 9, 1998

(51) Int. Cl.[7] ..... A47B 95/02
(52) U.S. Cl. ..... 16/113.1; 16/114.1; 280/47.37 R
(58) Field of Search ..... 16/115, 113.1, 16/405, 429; 190/18 A, 115; 280/47.37 R

(56) References Cited

U.S. PATENT DOCUMENTS 3,522,955 * 8/1970 Warner, Jr. ..... 16/115
3,697,095 * 10/1972 Howell ..... 280/47.37 R
4,118,048 * 10/1978 Spranger et al. ..... 280/47.37 R
4,974,871 * 12/1990 Mao ..... 16/115
5,249,438 * 10/1993 Rhaney et al. ..... 16/115
5,291,976 * 3/1994 Ku ..... 190/18 A
5,330,037 * 7/1994 Wang ..... 190/115
5,573,089 * 11/1996 Liang ..... 190/115
5,575,362 * 11/1996 Franklin et al. ..... 16/115
5,690,196 * 11/1997 Wang ..... 16/115
5,713,441 * 2/1998 Chen ..... 16/115
5,722,118 * 3/1998 Hansen et al. ..... 16/114 R
5,934,425 * 8/1999 Sadow ..... 190/115

FOREIGN PATENT DOCUMENTS

0187318 * 7/1986 (EP) ..... 190/115

* cited by examiner

*Primary Examiner*—Anthony Knight
*Assistant Examiner*—Mark Williams
(74) *Attorney, Agent, or Firm*—Lyon & Lyon LLP

(57) ABSTRACT

A telescoping handle assembly for luggage or other luggable items. A telescoping handle assembly is provided that includes a primary handle and a secondary handle. The secondary handle provides at least one gripping surface that, when deployed, may extend in a direction generally parallel to a direction that a traveler may move when transporting an item attached to the secondary handle from one location to another.

6 Claims, 8 Drawing Sheets

TELESCOPING HANDLE ASSEMBLY FOR LUGGAGE AND OTHER LUGGABLE ITEMS

BACKGROUND

The present invention relates generally to luggage and, more particularly, to improved telescoping handle assemblies for use on luggage and other luggable items including, for example, suit cases, brief cases, instrument cases, document bags, garment bags and the like.

Over the last few years, substantial attention has been directed toward the development of wheeled luggage items. Such items generally comprise a container (or case) for enclosing one or more items of clothes, toiletries and the like, a wheel assembly and an extendable or telescoping handle assembly. The wheel assembly and extendable handle assembly are affixed to the container such that the container may be pulled fairly easily from one point to another, for example, through an airport. In addition, conventional handle assemblies generally include a pair of telescoping support members that have a cross-bar or handle provided between their distal extremities. When configured in an extended position, the cross-bar or handle may be grasped by a traveler and used to pull the luggage item from one place to another. A locking mechanism is also generally provided such that the telescoping support members may be locked in either an extended or retracted position.

Some exemplary prior art travel bags having extendable handle assemblies are shown in U.S. Pat. No. 5,653,319, entitled "Retractable Handle for a Wheeled Travel Bag," U.S. Pat. No. 3,513,952, entitled "Extendable Handle Structure," U.S. Pat. No. 5,644,816, entitled "Extensible Drawbar Device of a Truck," U.S. Pat. No. 5,075,925, entitled "Retractable Handle Assembly for Transportable Case," U.S. Pat. No. 5,581,846, entitled "Controlling Handle Structure for Pull Rods of a Luggage," U.S. Pat. No. 5,630,488, entitled "Retractable Handle Positioning Structure for Luggage," and U.S. Pat. No. 5,636,410, entitled "Retractable Handle Assembly for a Suitcase."

The extendable handle assemblies illustrated and described in the above-listed patents and, indeed, all prior art handle assemblies known to applicant employ or utilize a handle assembly that requires a traveler to twist his or her hand roughly 90 degrees from a relaxed position when pulling a garment bag (or other luggable item) attached to the handle assembly. Such a configuration not only limits the leverage that is available to a traveler when transporting the garment bag but also may cause the traveler to suffer substantial muscle fatigue and discomfort in the wrist and forearm areas. Such a configuration also limits the lateral clearance that is available to a traveler when transporting the garment bag from one position to another.

Accordingly, it is believed that an improved handle assembly that allows a traveler to pull a garment bag or other luggable item using a more relaxed hand position would be quite useful. It is also believed that a handle assembly that provides multiple gripping surfaces and multiple carrying configurations would be quite useful. Finally, it is believed that a handle assembly that allows a traveler to achieve increased lateral clearance when pulling a garment bag (or other luggable item) from one location to another would be quite useful.

SUMMARY OF THE INVENTION

The present invention is directed to an improved extendable handle assembly for use on luggage and other luggable items.

In one particularly innovative aspect, an extendable or telescoping handle assembly in accordance with the present invention may allow a traveler to pull a garment bag (or other item) with minimal wrist and/or forearm twisting. Moreover, in one preferred embodiment an extendable handle assembly in accordance with the present invention may include a first or primary gripping surface that lies in a plane defined by a back surface of the garment bag and a secondary gripping surface. The secondary gripping surface is preferably moveable from a first, stored position to a second, extended position such that, when configured in the second position, the secondary gripping surface extends in a direction generally parallel to a direction that a traveler may move when transporting the garment bag from one location to another. Thus, it will be seen that, by using a telescoping handle assembly in accordance with the present invention, it is possible to greatly reduce traveler wrist and forearm discomfort and to maximize the leverage available to a traveler when the traveler must transport an item attached to the handle assembly from one location to another. It will also be seen that a telescoping handle assembly in accordance with the present invention may be "pushed" more easily, and may be more easily controlled when being pushed in a given direction, because of the added leverage and improved biomechanic s that are achieved through the use of such a handle assembly.

In another innovative aspect, the present invention is directed toward an extendable handle assembly that includes a generally U-shaped secondary handle. The generally U-shaped secondary handle is rotatably attached to a pair of telescoping support members such that, when the support members are extended, the secondary handle may be rotated from a stored position and latched in at least one deployed position. Preferably, when in the deployed position, at least one gripping section of the generally U-shaped secondary handle will conform to a natural pulling position of the hand and wrist of a traveler. For example, the generally U-shaped secondary handle may include a pair of gripping sections that may be rotated to extend within a vertical plane that is parallel to a direction that the traveler may be moving when transporting a luggable item attached to the handle assembly from one location to another. Further, when one of the gripping sections is grasped by a traveler and the item is properly positioned for toting or carrying, it is preferred that the gripping sections will lie in a substantially horizontal plane. Thus, it will be appreciated that, when the generally U-shaped secondary handle is deployed, it not only allows a traveler to transport the luggable item with reduced wrist and forearm discomfort but also provides the traveler with more leverage and improved biomechanics for maneuvering the item. The use of the generally U-shaped secondary handle also provides the traveler with additional lateral clearance from an associated luggable item and supports either right or left handed use.

In additional preferred embodiments, the generally U-shaped handle may be designed to lock in a plurality of deployed positions such that different carrying configurations may be achieved for different travelers. For example, the generally U-shaped handle may be configured to lock in a first plane forming a 45 degree angle with a back plane of the item and also within a second plane coextensive with the back plane to provide additional handle extension for taller travelers.

In still other embodiments, the secondary handle may take a form other than a U-shaped form. For example, the handle may take the form of a "tiller" extension or hinged handle assembly. The secondary handle may also comprise a section of a hinged telescoping tube.

In a second particularly innovative aspect, the present invention is directed to an extendable handle assembly that enables one-handed control of both a primary handle extension function and a secondary handle rotation or deployment function.

Accordingly, it is an object of the present invention to provide an improved extendable handle assembly for use on luggage and other luggable items.

It is another object of the present invention to provide a luggage item with an extendable handle assembly having an improved ergonomic design.

It is still another object of the present invention to provide a telescoping handle assembly the includes a generally U-shaped handle that may be rotated from a stored position and releasably fixed within one or more deployed positions.

It is still another object of the present invention to provide a telescoping handle assembly for use on luggage and other luggable items that includes a rotating handle and a locking mechanism that allows for one-handed control of both a handle extension function and a handle rotation function.

It is still another object of the present invention to provide a telescoping handle assembly for use on luggage and other luggable items that allows a traveler to pull an item attached to the handle assembly with reduced wrist and forearm fatigue and/or discomfort.

It is still another object of the present invention to provide a telescoping handle assembly that includes a primary handle and a deployable secondary handle, wherein the secondary handle may be used to provide a traveler with additional leverage and lateral clearance when an item attached to the handle assembly is toted from one location to another.

Other objects and features of the present invention will become apparent from consideration of the following description taken in conjunction with the accompanying drawings

BRIER DESCRIPTION OF THE DRAWINGS

Figure 3A:
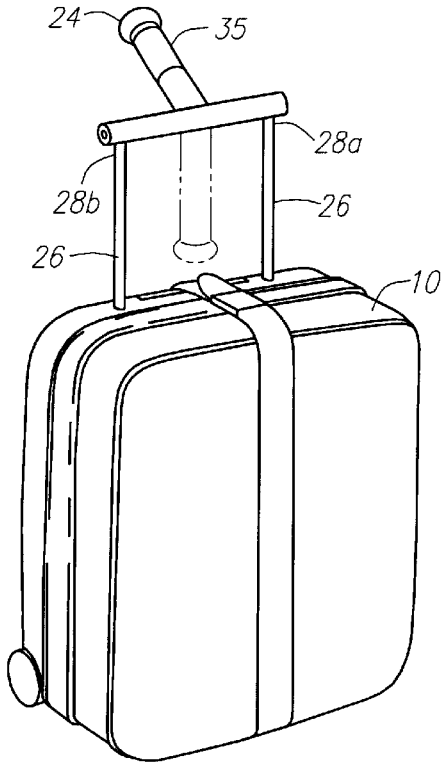
Figure 3B:
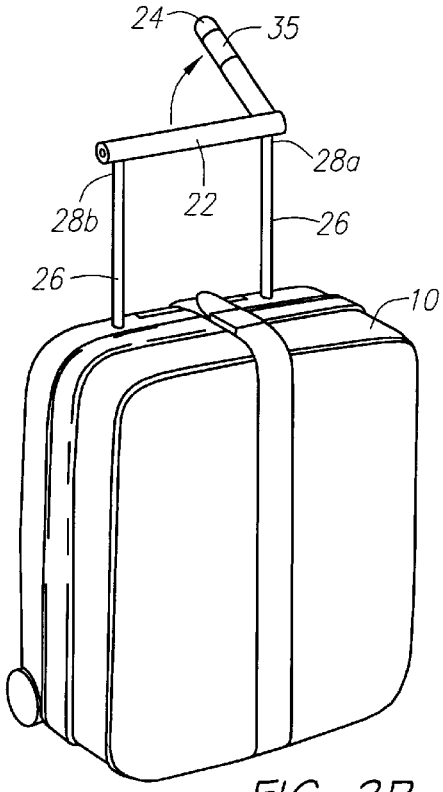
Figure 3C:
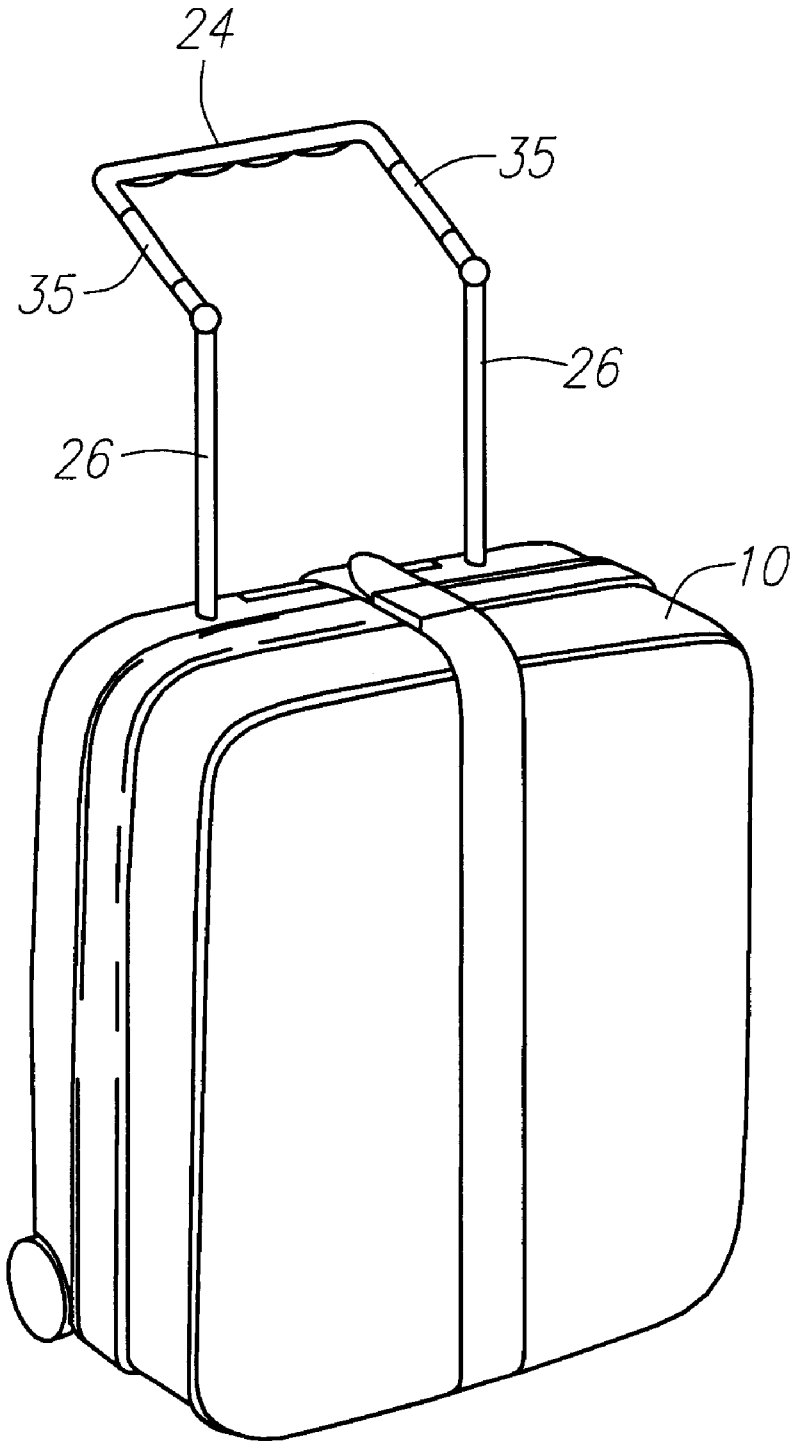
Figure 4A:
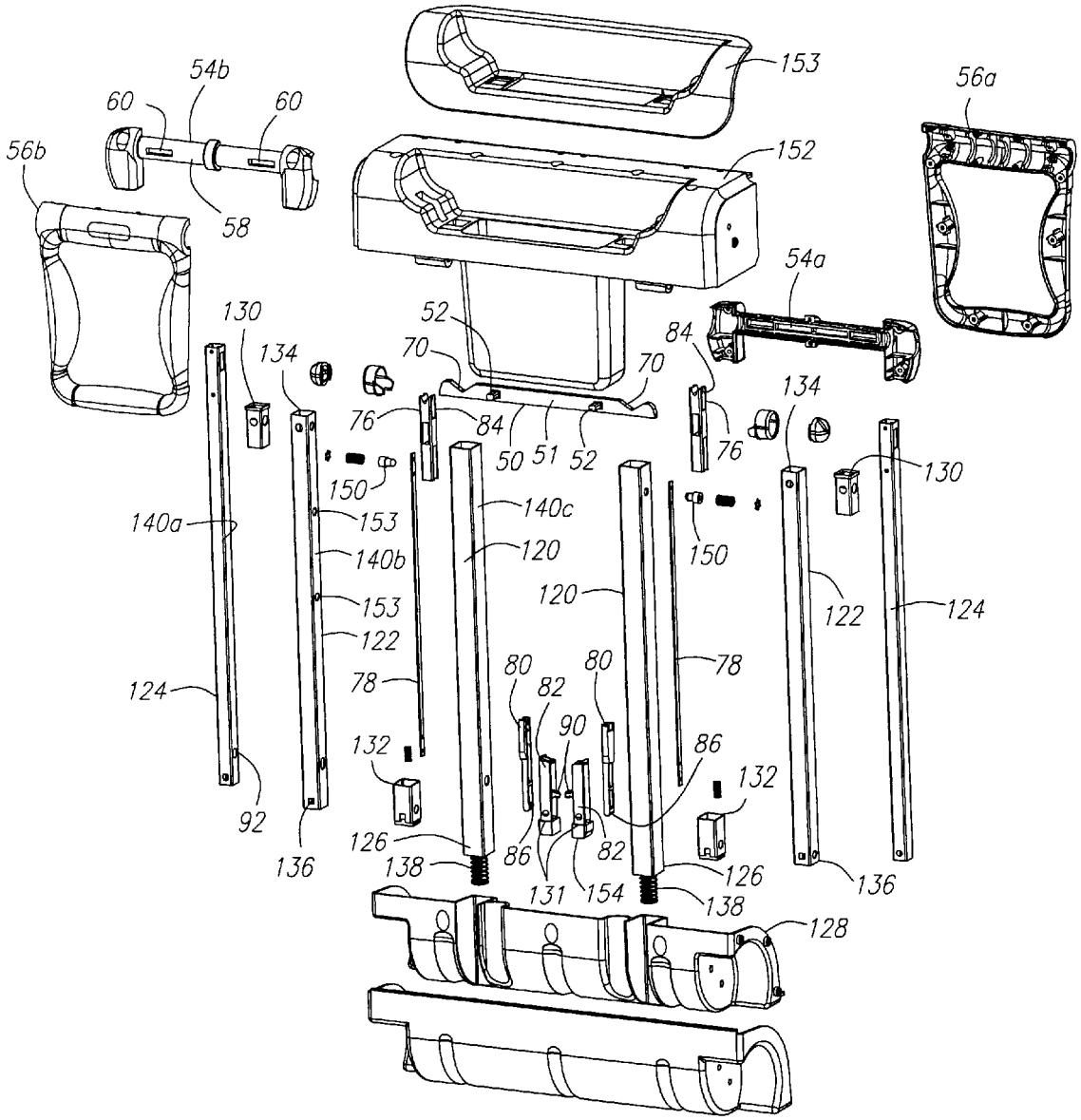
Figure 4B:
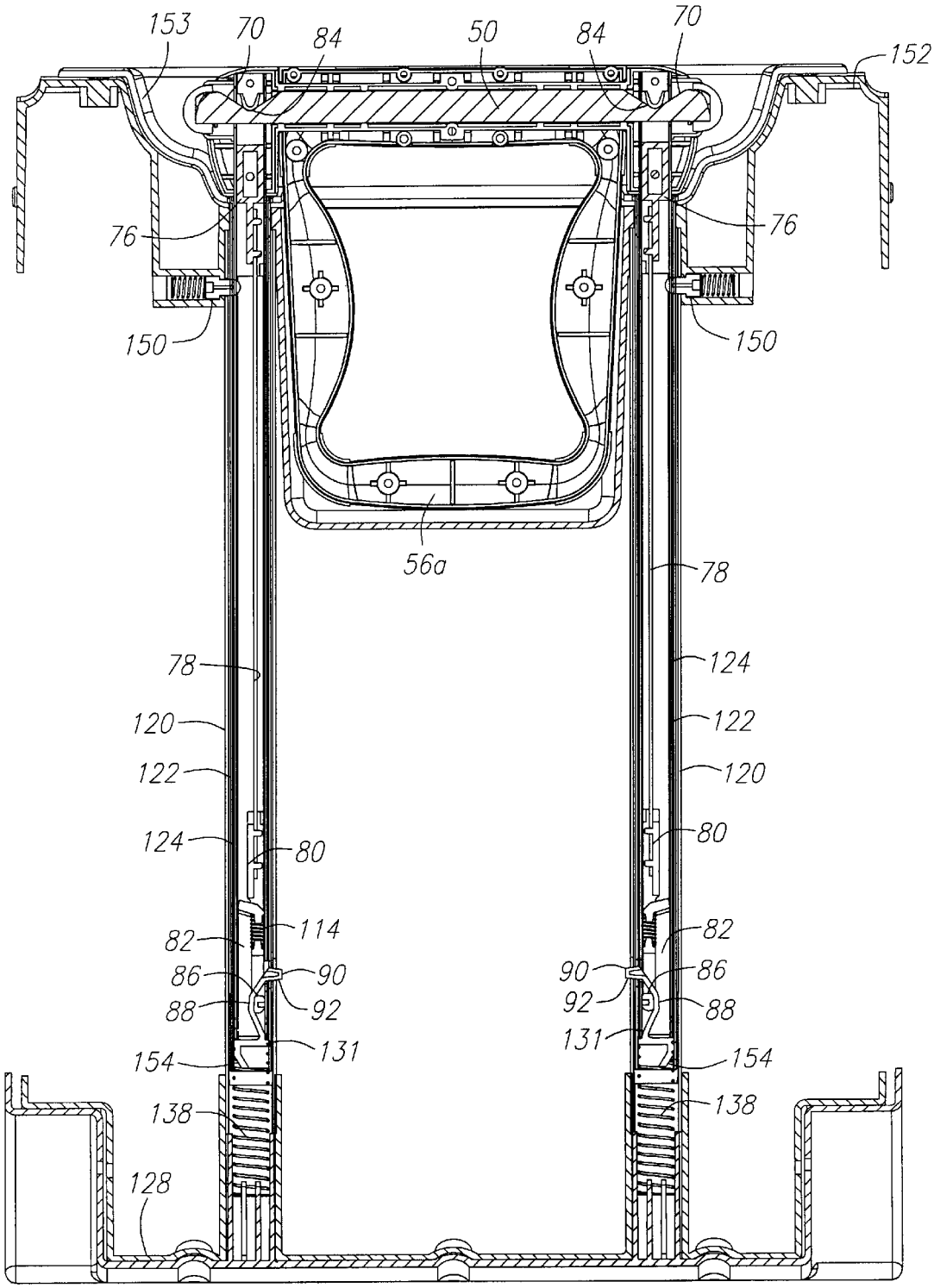
Figure 4C:
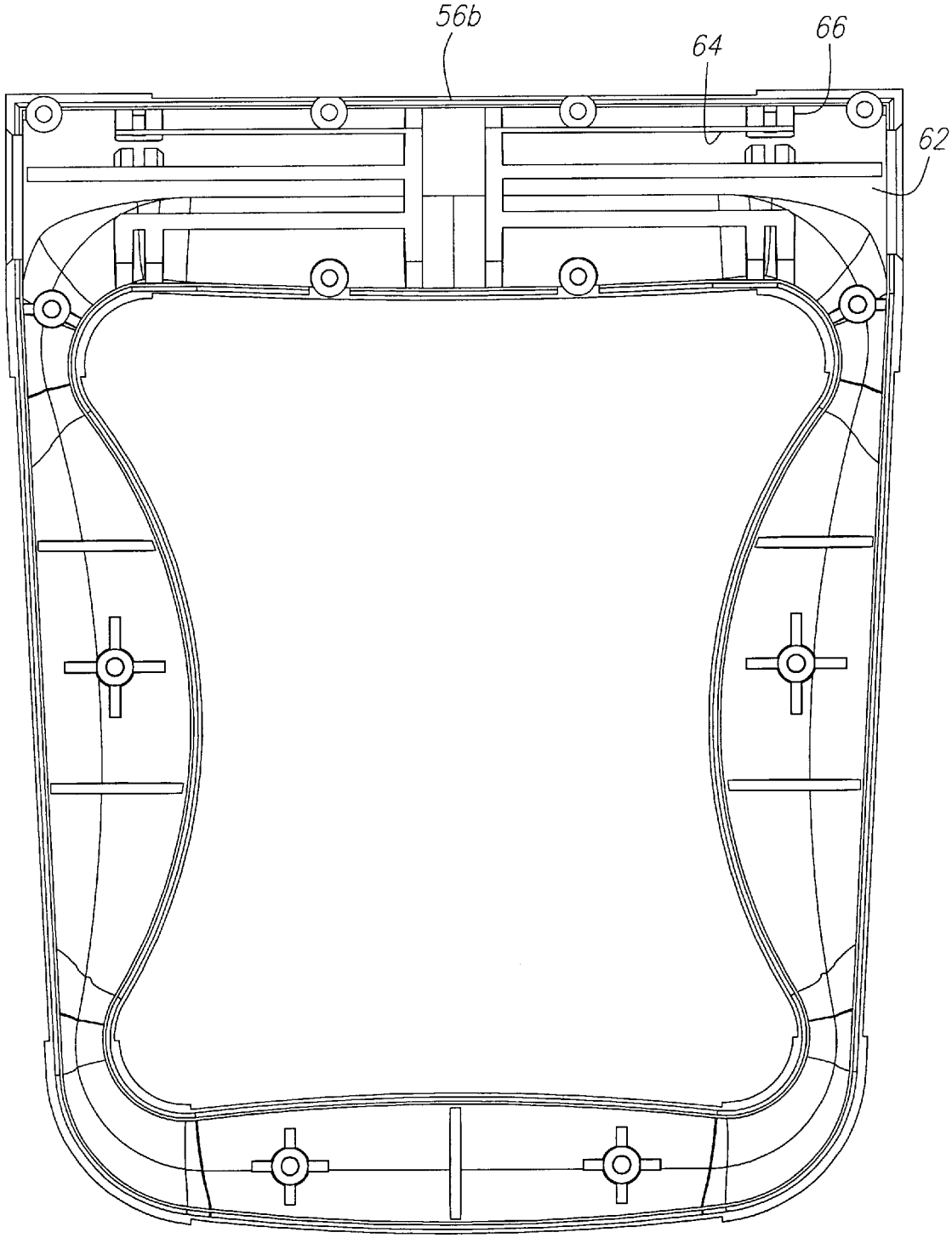
Figure 4D:
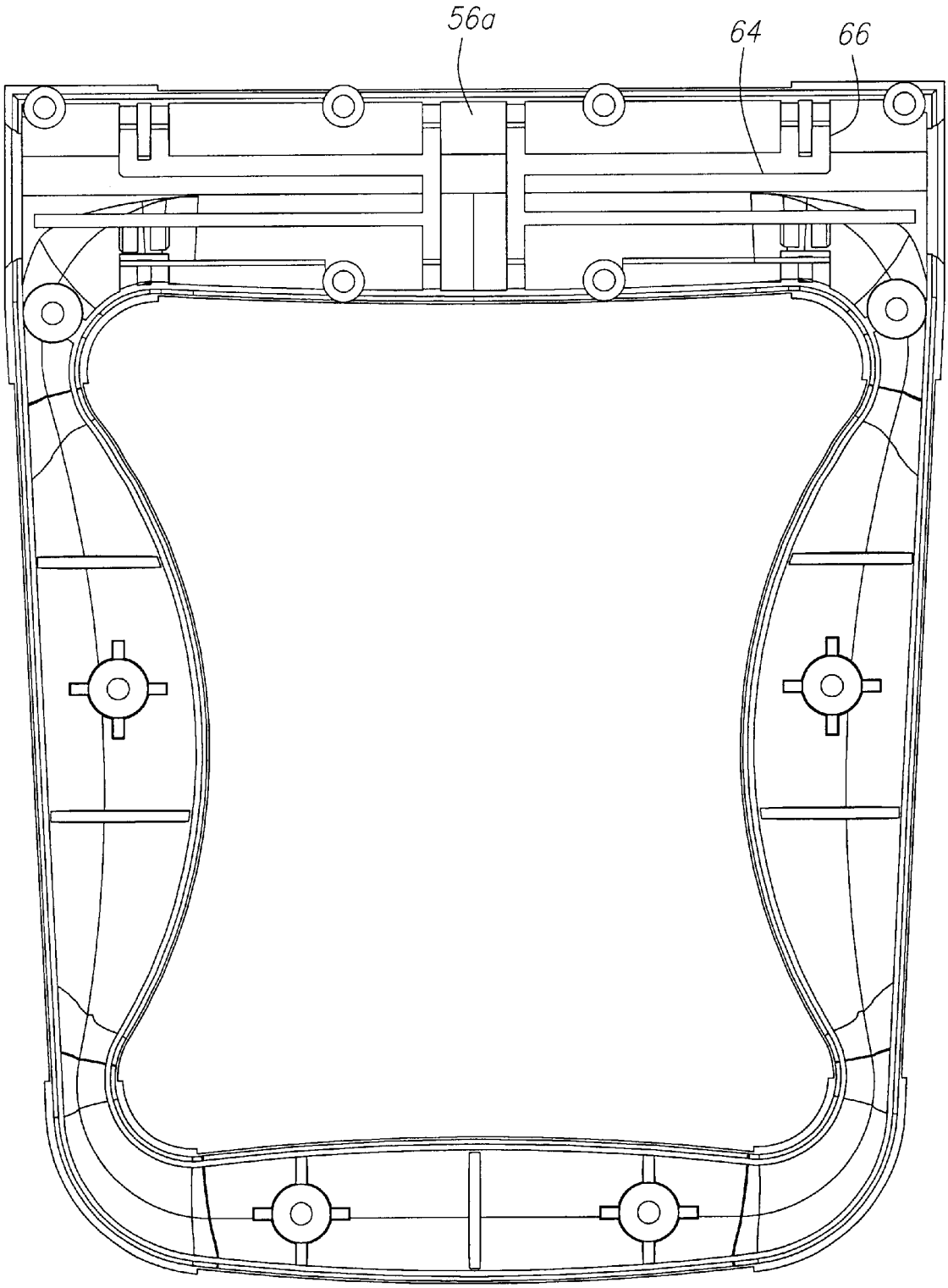

FIGS. 3(*a*)–3(*c*) provide illustrations of additional secondary handle configurations in accordance with the present invention.

Figure 2:
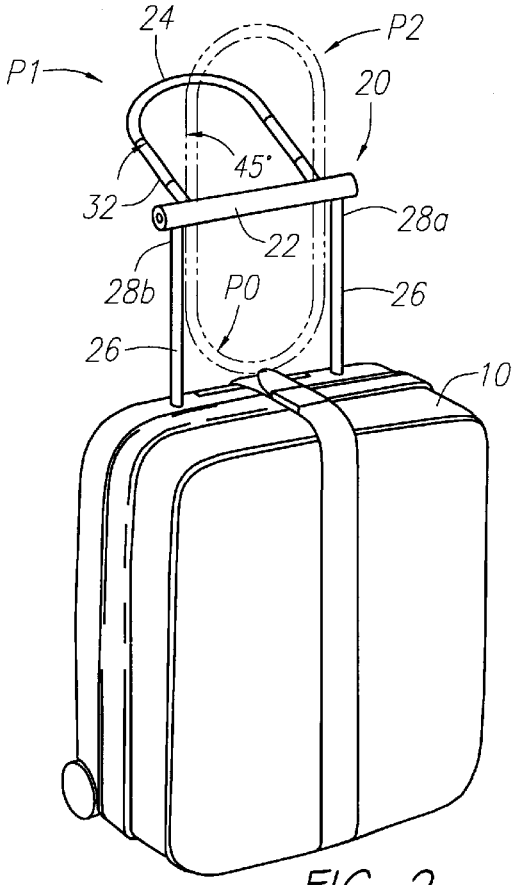
FIG. 2 is an illustration of an extendable handle assembly including a primary and secondary handle for a luggage item or other luggable item in accordance with a preferred form of the present invention.

FIG. 4(*a*) is an exploded view of the telescoping handle assembly shown in FIG. 2.

FIG. 4(*b*) is a cross-sectional view of the extendable handle assembly shown in FIG. 2.

FIG. 4(*c*) is a cross-sectional view of a front handle section of the handle assembly shown in FIG. 2.

FIG. 4(*d*) is a cross-sectional view of a back handle section of the handle assembly shown in FIG. 2.

Figure 5C:
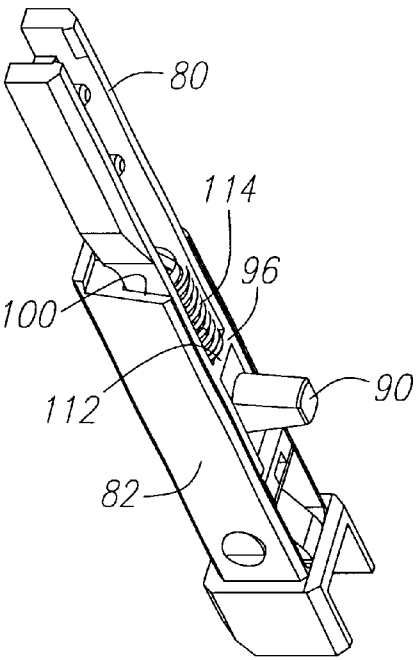
Figure 5B:
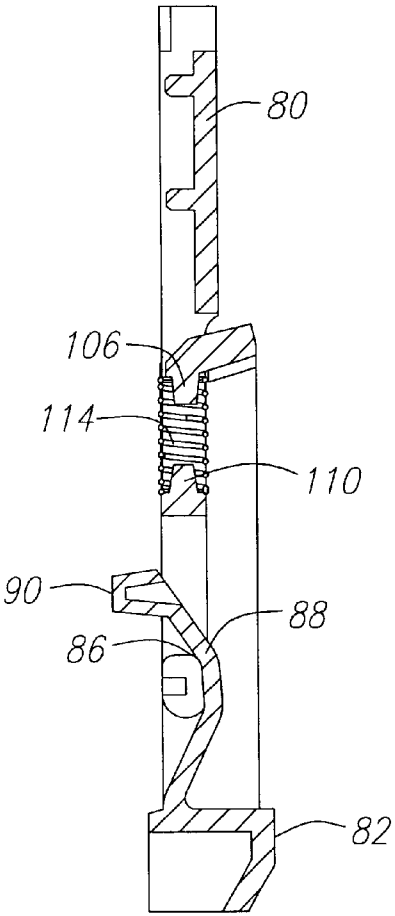
Figure 5A:
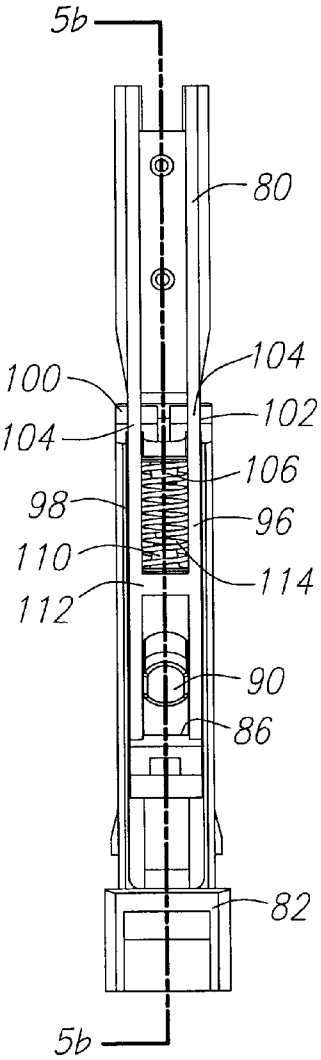

FIG. 5(*a*) is a first illustration of a lower actuator member and plunger assembly in accordance with a preferred form of the present invention.

FIG. 5(*b*) is a cross-sectional illustration along line A—A of the lower actuator member and plunger assembly illustrated in FIG. 5(*a*).

FIG. 5(*c*) is a second illustration of the lower actuator member and plunger assembly illustrated in FIG. 5(*a*).

DESCRIPTION OF PREFERRED EMBODIMENTS

In an effort to highlight various embodiments and innovative aspects of the present invention, a number of subheadings are provided in the following discussion. In addition, where a given structure appears in several drawings, that structure is labeled using the same reference numeral in each drawing.

Prior Art Handle Assemblies

Figure 1:
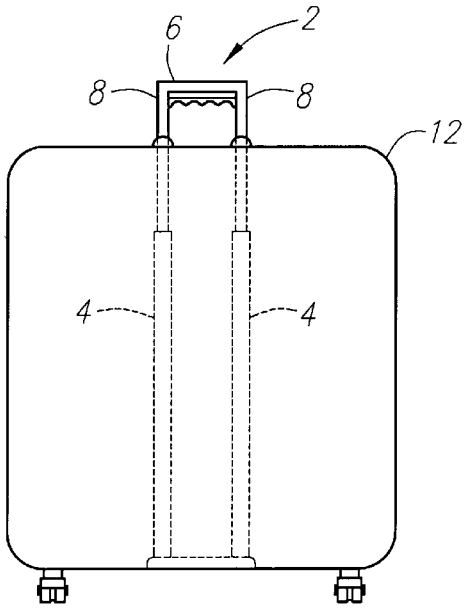
FIG. 1 (PRIOR ART)
FIG. 1 is an illustration of a typical prior art retractable handle assembly for a luggage item.

Turning now to the drawings, as shown in FIG. 1, typical prior art telescoping handle assemblies 2 for use on luggage and other luggable items generally include a pair of telescoping support members 4 having a handle 6 mounted between their distal extremities 8. It will be appreciated that the handle 6 of such handle assemblies 2 has a central axis 10 that is fixed in an orthogonal relationship to the direction that a bag 12 attached to the handle assembly is designed to be pulled (or pushed) in. For this reason, prior art telescoping handle assemblies often subject travelers to unnecessary wrist and forearm fatigue and, in some instances, pain. Prior art telescoping handle assemblies, by their design, also limit the leverage that is available to a traveler when transporting a bag (or other item) attached to the handle assemblies from one location to another. This is particularly noticeable when attempts are made to push prior art bags from one location to another.

Handle Assemblies in Accordance with the Present Invention

Turning now to FIG. 2, a telescoping handle assembly 20 in accordance with the present invention overcomes many of the deficiencies inherent in prior art systems. For example, in one preferred form, a telescoping handle assembly 20 in accordance with the present invention may comprise a primary handle 22 and a secondary handle 24 mounted between a pair of telescoping support members 26. The primary handle 22 and secondary handle 24 preferably comprise a unitary structure that is rotatably mounted to (or between) the distal ends 28*a* and 28*b* of the support members 26. In addition, the secondary handle 24 preferably has a generally U-shaped structure and may be selectively rotated from a stored position P0 to at least two deployed positions P1 and P2. When configured in the stored position P0, the secondary handle 24 preferably fits between the telescoping support members 26, such that the secondary handle 24 may be stored in a concealed housing when the support members 26 are retracted. When configured in the first deployed position P1, the secondary handle 24 preferably lies within a plane that forms approximately a 45° angle with a plane within which the support members 26 reside. However, in alternative embodiments, the angle formed may vary by+/−30° or more. It will be noted that the plane of the support members 26 is parallel to a back plane (not shown) of a container portion 30 of the luggable item 10. Further, when configured in the second deployed position P2, the secondary handle 24 preferably lies within the plane of the support members 26 and extends from the distal ends 28*a* and 28*b* of the telescoping support members 26. Finally, it is presently preferred that the secondary handle 24 comprise a generally U-shaped form providing a plurality of gripping areas 32, 33 and 34 that may be grasped by a traveler.

Thus, it will be appreciated that a telescoping handle assembly 20 in accordance with the present invention provides gripping surfaces 32 and 34 that, when the secondary handle 24 is configured in the first deployed position P1, extend within planes generally parallel to a direction that a traveler may move when transporting a luggable item attached to the handle assembly 20 from one location to another. Further, when an attached bag or luggable item 10 is properly positioned for toting, it is preferred that the gripping surfaces 32 and 34 lie within a horizontal plane (not shown). This allows a traveler, when transporting an attached bag or luggable item 10, to grasp either of the gripping surfaces 32 or 34 without having to twist his or her wrist substantially away from a relaxed position. It follows that, when transporting a bag or luggable item 10 in accordance with the present invention, a traveler is less likely to experience wrist and forearm fatigue and/or pain. Similarly, it will be appreciated that because the gripping areas 32 and 34 may be grasped with minimal twisting of a traveler's wrist, the traveler is provided with increased leverage due to improved body mechanics when utilizing a handle assembly 20 in accordance with the present invention. Further, because the gripping surfaces 32 and 34 are offset from the center line (not shown) of a bag or luggable item 10 attached to the handle assembly 20, the use of such a handle assembly will provide the traveler with additional lateral clearance when transporting the bag or luggable item 10 from one place to another. Those skilled in the art will appreciate that the increased leverage provided by a handle assembly 20 in accordance with the present invention is particularly useful when an attached bag or luggable item 10 is pushed from one location to another.

Those skilled in the art will appreciate that the generally U-shaped secondary handle 24 illustrated in FIG. 2 is but one example of how a secondary handle 24 may be configured in accordance with the present invention. Moreover, while the generally U-shaped secondary handle 24 illustrated in FIG. 2 provides a presently preferred configuration, several alternative embodiments would be considered to be equivalent and are described below. For example, the secondary handle 24 may take the form of a "tiller" extension, such as that shown in FIG. 3(*a*), the secondary handle 24 may take the form of a hinged structure, such as that shown in FIG. 3(*b*), or the secondary handle 24 may comprise a section of a hinged support member 26, as shown in FIG. 3(*c*). While none of these structures is presently preferred, it will be appreciated that each provides at least one gripping surface 35 that may be configured to extend within a plane (not shown) generally perpendicular to the plane (not shown) of an associated primary handle 22. Stated somewhat differently, the embodiments of FIGS. 3(*a*)–3(*c*) illustrate how alternative handle assemblies may be constructed in accordance with the present invention to provide improved ergonomics for a traveler and to provide a deployable secondary handle for use on luggage and other luggable items.

As further shown in FIG. 2, a luggable item 10 in accordance with the present invention may comprise a container 40, a wheel assembly 42 coupled to the container, and a telescoping handle assembly 20 such as that described above.

Turning now to FIGS. 4(*a*)–(*d*), the generally U-shaped secondary handle 24 is preferably implemented as follows. A control bar 50 having a plurality tabs 52 that extend outwardly from an exterior surface 51 thereof is slideably mounted within a handle bridge assembly 54, and an outer handle assembly 56 is rotatably mounted over the handle bridge assembly 54. The handle bridge assembly 54 preferably comprises an inner handle bridge 54*a* and an outer handle bridge 54*b*, and the outer handle assembly preferably comprises an outer handle 56*a* and an inner handle 56*b*. The handle bridge assembly 54 and outer handle assembly 56 are held together by conventional means, for example, through the use of screws or glue (not shown). The handle bridge assembly 54 has a wall 58 wherein a plurality of apertures 60 are formed. The apertures 60 are configured such that the tabs 52 of the control bar 50 may pass therethrough and slide laterally therein. The outer handle assembly 56 has an inner wall 62 wherein a plurality of axial channels 64 and radial channels 66 are formed. The tabs 52 of the control bar 50 slide within and selectively engage the walls of the axial and radial channels 64 and 66, such that the outer handle assembly 58 may be selectively fixed within a plurality of positions P0–P2 (shown in FIG. 2). For example, when the control bar 50 is placed in a "locked" position, the tabs 52 engage the walls of the axial channels 64, and the outer handle assembly 56 is prevented from rotating about the handle bridge assembly 54. However, when one end of the control bar 50 is depressed, causing the control bar to slide laterally, the tabs 52 are pushed into the radial channels 66, and the outer handle assembly 56 is allowed to rotate about the handle bridge assembly 54.

The control bar 50 also functions to control the telescoping action of the support members 26. A plurality of ramp surfaces 70 are provided along an upper surface 72 of the control bar 50, and the ramp surfaces 70 are used to drive a pair of actuator assemblies 74 provided within the telescoping support members 26. Each of the actuator assemblies 74 preferably includes an upper actuator member 76, a linking member 78, a lower actuator member 80, and a plunger assembly 82. The upper actuator members 76 are linked or coupled to the lower actuator members 80 by the linking members 78. Each of the upper actuator members 76 has a bearing surface 84 that is adapted to ride on a respective ramp surface 70 of the control bar 50, such that when the control bar 50 is moved laterally from a "locked" position to a "released" position, the bearing surfaces 84 of each upper actuator member 76 will ride up on a respective ramp surface 70 of the control bar 50 causing the actuator assemblies 74 to move upward within the telescoping support members 26. This action causes the bearing surfaces 86 of the lower actuator members 80 to engage respective spring members 88 of the plunger assemblies 82 and, in turn, causes the plungers 90 attached to the spring members 88 to be moved laterally out of holes 92 provided within an inward facing wall of an inner tube member 124 comprising the telescoping support 26.

Views of the lower actuator member 80 and plunger assembly 82 are provided in FIGS. 5(*a*)–5(*c*). As shown in FIGS. 5(*a*)–5(*c*), the respective lower actuator members 80 and plunger assemblies 82 are constructed such that a lower extremity 96 of each lower actuator member 80 fits within and slideably engages an upper portion 98 of the plunger assembly 84. More specifically, a cap section 100 of each plunger assembly 82 has a pair of recesses 102 formed therein. The recesses 102 are configured such that side walls 104 of the lower actuator member 80 may slide therein. In addition, the cap section 100 of each plunger assembly 82 includes a central protrusion comprising a spring mount 106. The spring mount 106 of each cap section 100 opposes a spring mount 110 provided on a cross-bar 112 provided between the side walls 104 of the lower actuator member 80, and a spring 114 is affixed at respective ends to the spring mounts 106 and 110. Thus, when the control bar 50 is returned to its "locked" position, the springs 114 force the lower actuator members 80 in a downward direction allowing the bearing surfaces 86 of the lower actuator members 80 to disengage the spring members 88 of the plunger assemblies 82, and allowing the plungers 90 to extend into holes 92.

Those skilled in the art will appreciate, of course, that the upper, intermediate and lower actuator members 78, 80 and 82 may comprise a single actuator member and that such a structure would clearly be equivalent to the multi-component actuator linkage described herein.

Turning again to FIGS. 4(*a*) and 4(*b*), in a preferred form, each telescoping support member 26 comprises an outer tube 120, an intermediate tube 122 and an inner tube 124. The lower end s 126 of the outer tubes 120 are affixed to the housing 128 of the wheel assembly 42. The intermediate tubes 122 are designed to slide within the outer tubes 120, and the inner tubes 124 are designed to slide within the intermediate tubes 122. In a preferred form, the outer tubes 120, intermediate tubes 122 and inner tubes 124 have a square cross-section. In addition, the outer tube preferably measures 0.750 inches on a side, the intermediate tube 122 measures 0.625 inches on a side, and the inner tube 124 measures 0.500 inches on a side.

The plunger assemblies 84 and actuator assemblies 74 are fixed within the inner tubes 124, and upper and lower bushings 130 and 132 are affixed within the upper and lower ends 134 and 136, respectively, of the intermediate tubes 122. The lower bushings 132 of the intermediate tubes 122 are capped closed-ended and engage springs 138 provided in the lower ends 126 of the outer tubes 120. The springs 138 force the intermediate tubes 122 and inner tubes 124 in an upward direction such that, when control bar 50 is moved laterally out of its "locked" position causing the plungers 90 of the plunger assemblies 84 to be withdrawn from holes 92 and into the inner tubes 124, the intermediate and inner tubes 122 and 124 are forced upward. This provide a traveler additional hand clearance around the handle assembly 20.

Each of the tubes 120, 122 and 124 preferably has an inward facing wall 140*a*, 140*b* and 140*c* wherein at least one hole 92 is formed. The holes 92 are sized such that the plunger 90 of the plunger assemblies 84 may fit therein, locking the tubes 120, 122 and 124 in a fixed position relative to one another until the plungers 90 are removed therefrom. In addition, the outer tubes 120 and intermediate tubes 122 have an outward-facing wall (not shown) wherein additional holes (not shown) are formed. These holes are designed to pass and engage a second plunger 150 mounted with the upper housing 152.

Finally, it will be noted that the upper bushings 130 of the intermediate tubes 122 are designed to engage an outwardly extending edge 131 of the plunger assemblies 84 to prevent the plunger assemblies 84 (and inner tubes 124) from passing completely out of the intermediate tubes 122.

The telescoping function of the support members 26 may be described as follows. When the control bar 50 is moved laterally, the bearing surface 84 of each upper actuator member 76 rides up on a respective ramp surface 70 causing the actuator assemblies 74 to move in an upward direction. This causes the lower actuator members 80 to move in an upward direction and, in turn, causes bearing surfaces 86 of the lower actuator members 80 to engage spring members 88. This causes plungers 90 to be moved out of holes 92 formed in the inward-facing walls of the outer, intermediate and inner tubes 120, 122 and 124. As plunger 90 is removed from holes 92, springs 138 force the intermediate and inner tube members 122 and 124 upward. Control bar 50 is then allowed to return to its "locked" position, and the handle assembly 20 may then be pulled upward until the plungers 150 may engage holes 146 formed within the outward-facing walls of the intermediate and outer tubes 122 and 124, and until the plungers 90 engage one of holes 153 formed in the inward-facing wall of the intermediate tube 122.

To return the telescoping members 26 to their retracted position, the control bar 50 is again moved laterally into its "released" position. This causes the actuator assemblies 74 to again move upward removing plungers 90 from holes 153*a–d*. This enables the inner tube 124 to slide within intermediate tube 122. As inner tube 124 slides downward within intermediate tube 122, ramp surfaces 154 provided on the plunger assemblies 84 will engage plungers 150 and force them outward of holes 146 enabling the intermediate tube 122 to slide within the outer tube 120. The inner and intermediate tubes 124 and 122 may then move downward within the outer tubes 120 until the plungers 90 again engage holes 92.

In view of the foregoing, it will be appreciated that, through the utilization of a control bar 50 in accordance with the present invention, one handed control of both the handle rotation (or deployment) function and the handle telescoping function is achieved.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A luggage item comprising a container substantially in the shape of a rectangle including a back side and bottom surface, a wheel assembly mounted substantially at the interface of the back side and bottom surface of the container, and a telescoping handle assembly coupled to the container, the telescoping handle assembly including first and second telescoping posts extendible from the top surface of the container, and a cross member comprising a control bar coupled at and extending between the distal ends of the telescoping posts, the handle assembly further including a single unitary U-shaped handle coupled to and pivotal about the control bar to a storage position when the posts are collapsed within the container, and the U-shaped handle having substantially perpendicular first and second gripping surfaces for providing ergonomic gripping surfaces, and the U-shaped handle further being pivotal into any one of a plurality of selectable engageable fixed positions, to enable comfortable gripping by the hand of a user of the container for enabling the container to be moved via the wheel assembly.

2. A luggage item as in claim 1 wherein the first gripping surface comprises a housing portion of the U-shaped handle rotatably mounted over the cross member, and the second gripping surface comprises a portion of the U-shaped handle perpendicular to the housing position.

3. A luggage item as in claim 1 wherein the control bar can be moved laterally with respect to the posts to allow the U-shaped handle to be unlocked and moved into any one of the plurality of fixed pivotal positions.

4. A luggage item as in claim 1 wherein the first gripping surface of the U-shaped handle comprises a housing portion rotatably mounted over the cross member, and the handle and cross member have cooperating members whereby lateral movement of the control bar locks and unlocks the U-shaped handle with respect to the control bar to allow the handle to be pivoted into any one of the plurality of selectable engageable fixed positions.

5. A luggage item as in claim 4 wherein the first and second telescoping posts each comprise a plurality of telescoping tubes.

6. A luggage item comprising a container substantially in the shape of a rectangle including a back side and bottom surface, a wheel assembly mounted substantially at the interface of the back side and bottom surface of the container, and a telescoping handle assembly coupled to the container, the telescoping handle assembly including first and second telescoping posts each comprising a plurality of telescoping tubes extendible from an area substantially at the back side and top surface of the container, and a cross member comprising a control bar coupled at and extending between the distal ends of the telescoping posts, the handle assembly further including a single unitary U-shaped handle coupled to and pivotal about the control bar to a storage position when the posts are collapsed within the back side of the container, and the U-shaped handle having substantially perpendicular first and second gripping surfaces for providing ergonomic gripping surfaces, and the U-shaped handle further being pivotal into any one of a plurality of selectable engageable fixed positions, to enable comfortable gripping by the hand of a user of the container for enabling the container to be moved via the wheel assembly, and the first gripping surface of the U-shaped handle comprises a housing portion rotatably mounted over the cross member, and the second gripping surface comprises a potion of the U-shaped handle perpendicular to the housing portion, and the handle and cross member have cooperating members whereby lateral movement of the control bar locks and unlocks the U-shaped handle with respect to the control bar to allow the handle to be pivoted and locked into any one of the plurality of selectable engageable fixed positions.

* * * * *